US008896637B2

(12) United States Patent
Tagawa et al.

(10) Patent No.: US 8,896,637 B2
(45) Date of Patent: Nov. 25, 2014

(54) SELF-LIGHT EMITTING DEVICE PANEL, IMAGE DISPLAY DEVICE AND PASSIVE DRIVING METHOD OF SELF-LIGHT EMITTING DEVICES

(75) Inventors: Yasuhiro Tagawa, Tokyo (JP); Eizo Okamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 1040 days.

(21) Appl. No.: 12/886,668

(22) Filed: Sep. 21, 2010

(65) Prior Publication Data

US 2011/0080434 A1 Apr. 7, 2011

(30) Foreign Application Priority Data

Oct. 2, 2009 (JP) ..... 2009-230852

(51) Int. Cl.

| | |
|---|---|
| ***G09G 5/10*** | (2006.01) |
| ***G09G 5/00*** | (2006.01) |
| ***G09G 3/32*** | (2006.01) |
| ***G09G 3/20*** | (2006.01) |

(52) U.S. Cl.

CPC ..... *G09G 3/2003* (2013.01); *G09G 2300/0426* (2013.01); *G09G 2310/0259* (2013.01); *G09G 3/3266* (2013.01); *G09G 3/3216* (2013.01); *G09G 3/3291* (2013.01)

USPC ..... 345/690; 345/212

(58) Field of Classification Search

USPC ..... 345/690, 173, 174, 211, 212, 87, 88

See application file for complete search history.

(56) References Cited

FOREIGN PATENT DOCUMENTS

| | | | | |
|---|---|---|---|---|
| JP | 2003-280586 | * | 10/2003 | ..... G09G 3/20 |
| JP | 2003-280586 A | | 10/2003 | |
| JP | 2009-037165 A | | 2/2009 | |

* cited by examiner

*Primary Examiner* — Michael Faragalla

(74) *Attorney, Agent, or Firm* — Sony Corporation

(57) ABSTRACT

A self-light emitting device panel includes: a pixel array in which pixel trios each including a set of three light emitting devices which emit light of three primary colors respectively are arranged in matrix in a row direction and a column direction; a plurality of column lines extending in the column direction of the pixel array, arranged in a cyclic manner in different proportions according to corresponding colors in the row direction, which are connected to one ends of plural light emitting devices emitting light of corresponding colors in the column of the pixel trios arranged in the same column; and a plurality of row-scanning lines extending in the row direction of the pixel array, arranged so as to be separated between at least two colors, which are connected to the other ends of the light emitting devices emitting light of corresponding colors.

9 Claims, 6 Drawing Sheets

SELF-LIGHT EMITTING DEVICE PANEL, IMAGE DISPLAY DEVICE AND PASSIVE DRIVING METHOD OF SELF-LIGHT EMITTING DEVICES

BACKGROUND OF THE INVENTION

1. Field of the Invention

The present invention relates to a self-light emitting device panel in which pixel trios each including a set of three light-emitting devices which emit light of three primary colors respectively are arranged in matrix in a row direction and a column direction. The invention also relates to an image display device including a data driver and a scan driver driving the self-light emitting device panel. The invention further relates to a passive driving method of self-light emitting devices capable of alleviating a row wiring pitch of drive lines extending in the column direction.

2. Description of the Related Art

The image display device in which LED light emitting devices (self-light emitting devices) of three primary colors (RGB) are arranged in matrix is known. Sub-pixels of respective colors of RGB construct one pixel. Alternatively, three pixels of RGB form one pixel trio. Hereinafter, the latter notation is applied in the specification of the invention.

In the image display device, there are a system in which active drive (also referred to as matrix drive) is possible by providing switches in respective pixels and a system in which passive matrix drive is possible by including just an LED and wiring for supplying current to the LED in each pixel. The passive matrix drive is one of passive driving systems as it is the system driven without through the switch of each pixel.

When the vertical direction of a pixel array is set as a column direction and the horizontal direction thereof is set as a row direction, wiring lines in the column direction are called column lines and wiring lines in the row direction are called row-scanning lines. In the passive matrix drive system, one light-emitting device is connected to each intersection between the column line and the row-scanning line.

The image display device normally includes the data driver and the scan driver within a display panel or as external attachment.

The data driver performs current driving or voltage driving of respective N-pieces of column lines corresponding to the number of pixels in the horizontal direction of a display screen so as to obtain luminance corresponding to data values.

The scan driver line-sequentially scans respective M-pieces of row-scanning lines corresponding to the number of pixels in the vertical direction to thereby selectively form paths of current flowing through the self-light emitting devices by the data driver.

In the image display device of the passive driving system, the self-light emitting devices are directly connected between arbitrary column lines and row-scanning lines. The data driver applies, for example, a voltage value capable of allowing current corresponding to pixel tones to N-pieces of column lines arranged at equal intervals in the row direction all at once. At that time, the scan driver allows one arbitrary row-scanning line to be in a state of applying current through the line (active state) and repeats the state line sequentially in the column direction to thereby perform scanning.

At this time, as LEDs are line-sequentially driven in the passive driving, LEDs in one line (hereinafter, referred to simply as a pixel line) emit light for only a period of time obtained by dividing a scanning period (V-period) of one screen by the number of pixels in the column (vertical) direction at the maximum. For example, in the image drive device having 1920×1080 pixels corresponding to FHD (Full High Definition), one pixel line emits light for a period of $1/1080$ of the V-period.

Accordingly, in order to obtain necessary luminance, a method of increasing the peak luminance at the time of lighting the LEDs instantaneously and the like can be considered. However, electric current to be applied to the LEDs is limited by various reasons, therefore, it is difficult to obtain necessary display luminance (brightness per a unit area in the display screen) particularly in a large screen.

On the other hand, luminance can be increased by allowing the lighting period of time to be longer by adding a drive circuit to each LED in the active drive system, therefore, the large screen image display device generally applies the active drive system.

However, in the active drive system, the circuit for controlling the lighting period is complicated, which increases costs.

Accordingly, as a method for increasing luminance while taking advantage of the passive driving system with low costs, a method of lighting plural pixel lines at the same time though the line-sequential scanning is proposed (refer to JP-A-2003-280586 (Patent Document 1) and JP-A-2009-037165 (Patent Document 2)).

In Patent Document 1, the method of dividing the display screen into plural screens and driving them at the same time is disclosed. According to the application of the method, display luminance is improved by driving plural pixel lines at a certain period of time as a whole display screen.

On the other hand, in Patent Document 2, plural pixel lines adjacent in the column direction are driven at the same time, and the drive of the plural pixel lines are scanned seamlessly so that pixel lines partly overlap.

The both methods are effective for improving low display luminance which is a disadvantage of the passive driving.

SUMMARY OF THE INVENTION

However, in the above method of Patent Document 2, a wiring pitch becomes closer particularly in the row direction as the screen size is increased. That is, in order to input different data to different light emitting devices of plural pixel lines in the column direction driven at the same time, it is necessary to previously separate column lines according to the color in accordance with the number of plural lines driven at the same time. Accordingly, as the number of pixel lines driven at the same time in the column direction is increased for improving luminance, the space for arranging the increased column wiring lines in the row direction will be reduced.

This is associated with the fact that brightness per a unit area (display luminance) is reduced suddenly when the screen size is increased while the definition of display images is determined by standards.

When the screen size (inch size of opposing corners) of the display device displaying images of the same definition is increased and display luminance is reduced, the screen becomes dark, therefore, the request for brightening the screen as a product is increased. At this time, the light-emitting luminance outputted from the number of light-emitting devices corresponding to the definition is the same and only the image display area is enlarged two-dimensionally, therefore, the probability that the screen becomes dark is higher than the probability that the screen size (inch size of opposing corners) is increased one dimensionally. That is, in the case that no countermeasure is taken, the screen becomes significantly dark only when the inch size is increased a bit.

When the technique of Patent Document 2 is applied for increasing display luminance, the size in the horizontal direction (row direction) is increased in proportion to the enlarged screen size only one-dimensionally. Therefore, in the case that the technique of Patent Document 2 is applied, when the number of pixel lines in the column direction driven at the same time is increased to the degree that display luminance is desired to be increased, it is difficult to house the column lines increasing at the same proportion (density) in space of the horizontal direction which is enlarged only one-dimensionally. This will be more difficult as the screen size becomes large.

The difficulty is basically the same as in the case that the screen is divided into two parts of up and down by applying Patent Document 1.

In Patent Document 1, the number of light-emitting devices is increased in RGB at the same proportion for increasing luminance (display luminance) of the display screen, visible sensitivity is not considered in this method. That is, the proportions of color components of RGB in visible sensitivity characteristics are different, and when RGB are increased to be double in luminance, the entire ratio a color component having larger proportion in visible sensitivity is reduced in a large scale.

Thus, it is desirable to provide a passive driving self-light emitting device panel capable of alleviating the wiring pitch when the size of the pixel array becomes large and the number of wiring lines to be arranged in the row direction is increased. It is also desirable to provide an image display device including the pixel array and drivers thereof capable of alleviating the wiring pitch in the same manner as the self-light emitting device panel. It is further desirable to provide a passive driving method of the self-light emitting devices capable of alleviating the wiring pitch.

A self-light emitting device panel according to an embodiment of the invention includes a pixel array, a plurality of column lines and a plurality of row-scanning lines.

In the pixel array, pixel trios each including a set of three light emitting devices which emit light of three primary colors respectively are arranged in matrix in a row direction and a column direction.

The plurality of column lines extends in the column direction of the pixel array, arranged in a cyclic manner in different proportions according to corresponding colors in the row direction, which are connected to one ends of plural light emitting devices emitting light of corresponding colors in the column of the pixel trios arranged in the same column.

The plurality of row-scanning lines extends in the row direction of the pixel array, arranged so as to be separated between at least two colors, which are connected to the other ends of the light emitting devices emitting light of corresponding colors.

According to the above configuration, the plural column lines are arranged in a cyclic manner in different proportions according to corresponding colors in the row direction. In this case, a color having small arrangement proportion of column lines have a shorter cycle (interval) of arranging column lines. Accordingly, when performing row-line driving of the pixel trios, it is possible to allow the larger number of light emitting devices to emit light in the color having smaller arrangement proportion of column lines. However, the pixel trio includes a set of three light emitting devices which emit light of respective colors, therefore, it is not preferable that the number of lighting devices differs according to the color in the same row.

On the other hand, in the passive driving in which light-emitting devices connected between the column lines and the row-scanning lines, the arrangement proportion of the column wiring lines in the row direction differs according to the color, therefore, the following effects are brought about when seeing from the column direction.

The number of light emitting devices simultaneously emitting light at the time of row-scanning is limited in the light emitting device corresponding to the color having smaller arrangement proportion of column lines in the row arrangement. Therefore, in plural row-scanning lines simultaneously driven in the row-scanning, the number of light emitting devices which can emit light is increased in the light emitting device having larger arrangement proportion of the column lines in one row. That is, when the number of row-scanning lines simultaneously driving in the row-scanning is selected properly, the number of light emitting devices which emit light, for example, in the proportion corresponding to visible sensitivity can be increased even when the wiring proportion of column lines is reduced in the color having smaller proportion occupied in visible sensitivity.

The number of arranging column lines in the row direction can be reduced to the minimum necessary while maintaining characteristics of visible sensitivity by using the above property.

Another self-light emitting device panel according to an embodiment of the invention includes the pixel array and a passive driving wiring group.

In the passive driving wiring group, respective plural column lines and plural row-scanning lines are connected to be paired to one ends and the other ends of corresponding to light emitting devices. At this time, the number of column lines connected to the light emitting device of a color having low proportion of the color component in visible sensitivity is reduced according to the proportion in respective rows of the pixel array, while the numbers of light emitting devices in respective colors simultaneously driven are allowed to be the same. In the passive driving wiring group, light emitting devices of respective colors can emit light in plural rows in the same proportion as the proportion of the plural column lines being arranged so as to correspond to the proportion of the color components in the row direction in one row of the pixel column concerning the column direction of the pixel array. Accordingly, the simultaneous lighting of plural rows can be sequentially scanned in the column direction.

An image display device according to an embodiment of the invention includes a data driver and scan drivers, in addition to the pixel array, the plurality of column lines and the plurality of row-scanning lines.

The data driver drives the plurality of column lines by electric current in accordance with input data.

The scan drivers simultaneously drives the different numbers of row-scanning lines according to the color for forming paths of current flowing through the light emitting devices in plural rows of the pixel trios at the same time by the data driver, and sequentially repeats the operation of simultaneous driving in the row direction.

In a passive driving method of self-light emitting devices according to an embodiment of the invention, light emitting devices of a pixel array in which pixel trios each including a set of three light emitting devices which emit light of three primary colors respectively are arranged in matrix in a row direction and a column direction are passive-driven without through switches of respective pixels. At that time, the number of column lines extending in the row direction and connected to light emitting devices of a color having low proportion of the color component in visible sensitivity is reduced. On the other hand, the proportions of light emitting devices simultaneously driven in respective colors are allowed to be the same, and the number of light emitting devices simultaneously driven with respect to plural columns of pixel trios is allowed to be different in the proportion corresponding to the proportion in visible sensitivity. Accordingly, the row wiring pitch of driving lines extending in the column direction is alleviated.

According to the embodiments of the invention, the passive driving self-light emitting device panel capable of alleviating the wiring pitch in the case that the pixel array size is enlarged and the number of wiring lines arranged in the row direction is increased. Also according to the embodiments of the invention, the image display device including the pixel array and the drivers thereof capable of alleviating the wiring pitch can be provided in the same manner as the self-light emitting device panel. Further, according to the embodiments of the invention, the passive driving method of the self-light emitting devices capable of alleviating the wiring pitch can be provided in the same manner.

DESCRIPTION OF THE PREFERRED EMBODIMENTS

Figure 1:
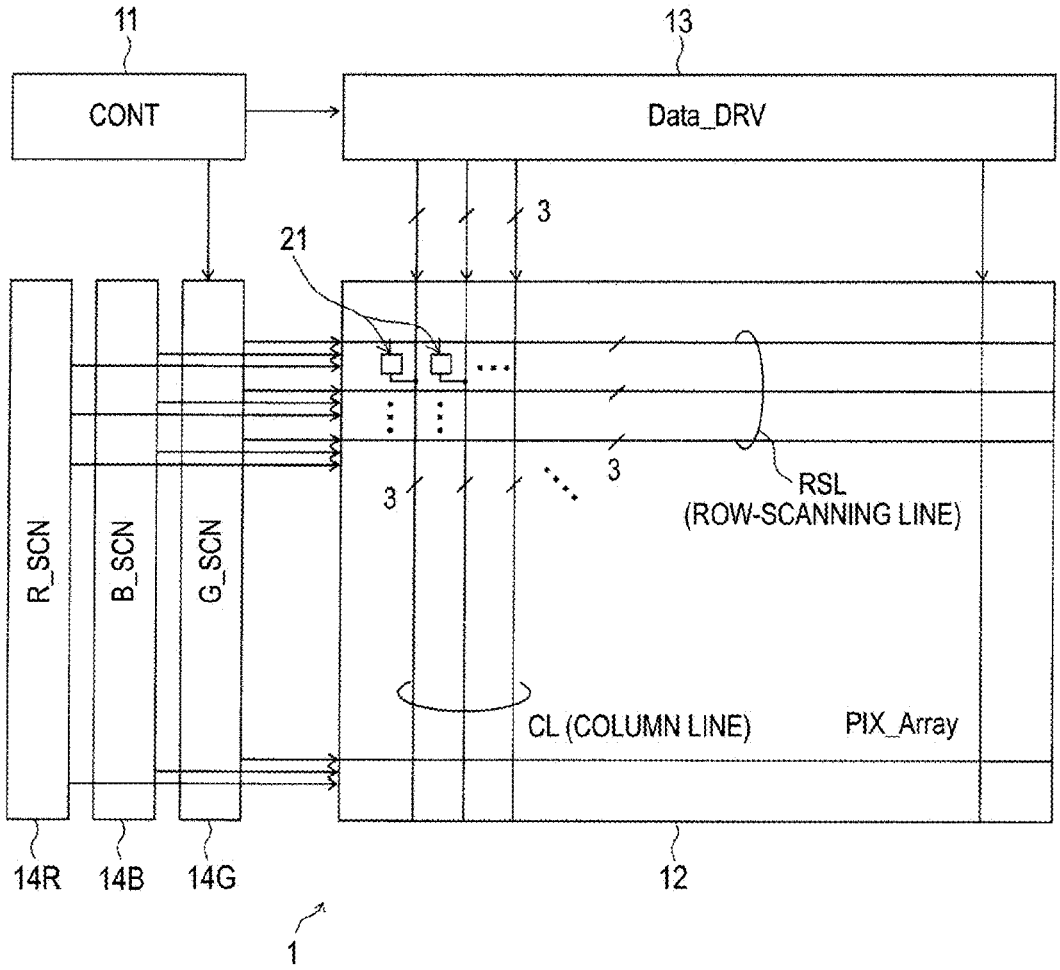
FIG. 1 is a block configuration diagram of a passive driving system image display device according to an embodiment of the invention.

Embodiments of the invention will be explained with reference to the drawings by using an image display device as an example in the following procedure. A self-light emitting device panel according to an embodiment of the invention is disclosed by a configuration of a pixel array unit (refer to FIG. 1), which is included in the following explanation.

1. Whole configuration of an image display device
2. Configuration example of drivers
3. Detailed connection configuration example of light-emitting devices
4. Proportion of arranging column lines in respective colors
5. First and second comparative examples
6. Advantages of the embodiment with respect to the comparative examples

1. Whole Configuration of an Image Display Device

FIG. 1 is a block configuration diagram of a passive-driving image display device according to the embodiment.

An image display device 1 shown in FIG. 1 includes a controller (CONT) 11, a pixel array unit (PIX_Array) 12, a data driver (Data_DRV) 13 and scan drivers 14G, 14B and 14R (G_SCN, B_SCN, R_SCN) of respective colors.

The controller 11 receives input of image data corresponding to images to be displayed on the pixel array unit 12 and controls the data driver 13 and the scan drivers 14.

In the pixel array unit 12, pixel units (PIX) 21 are arranged in matrix. The number of arranging the pixel units 21 (pixel trio) in the row direction (horizontal direction) corresponds to the definition of the display screen in the horizontal direction. The number of arranging the pixel units 21 in the column direction (vertical direction) corresponds to the definition of the display screen in the vertical direction.

Each of plural pixel units 21 arranged in matrix includes three light emitting devices emitting light of RGB.

Column lines CL for connecting each light emitting device to the data driver 13 are connected to plural pixel units 21. Further, row-scanning lines RSL for driving light emitting devices of corresponding colors by any of the three scan drivers 14G, 14B and 14R provided so as to correspond to each color are connected to plural pixel unit 21.

In FIG. 1, one column line CL and one row-scanning line RSL are connected to one pixel unit 21 in the pixel array unit 12. However, three column lines CL and three row-scanning lines RSL are connected to one pixel unit 21 respectively in fact so that three light-emitting devices of the pixel unit 21 can be driven by each color.

That is, it is necessary to supply signals of three colors which are R (red), G (green) and B (blue) in respective pixel units 21 because the pixel array unit 12 performs full-color display, therefore, the column lines CL which are three times the number of pixels arranged in the horizontal direction are provided in columns in one frame, and outputs of the data driver 13 are connected thereto. When the light emitting devices which emit light of respective colors are LEDs, anodes thereof are driven by the data driver 13 through the column lines CL.

Additionally, the row-scanning lines RSL which are three times the number of horizontal lines (rows) in rows in one frame. According to the embodiment of the invention, the row-scanning lines RSL are separated according to respective colors. When the light emitting device emitting light of red (R) is the LED, a cathode thereof is connected to the R scan driver 14R through a row-scanning line RSLr which is dedicated to R. Similarly, when the light emitting device emitting light of green (G) is the LED, a cathode thereof is connected to the G scan driver 14G through a row-scanning line RSLg which is dedicated to G. Furthermore, when the light emitting device emitting light of blue (B) is the LED, a cathode thereof is connected to the B scan driver 14B through a row-scanning line RSLb which is dedicated to B.

As described above, the circuit configuration of the embodiment includes the row-scanning lines RSL being separated according to the color and can be driven by three circuits corresponding to each color. It is also preferable that one scan driver integrates the functions of scan drivers of respective colors.

In the passive-driving image display device 1 according to the embodiment, the number of wiring lines of respective colors is varied from the equivalent number of wiring lines intentionally, which will be described later. The number of light emitting devices which can be driven may differ according to the color. The embodiment differs from the passive matrix arrangement in that point.

As three self-light emitting devices forming the pixel trio of the pixel unit 21, for example, the LED (Light Emitting Diode) main component of which is a compound semiconductor can be used. Also as the self-light emitting device, an organic EL device (OLED: organic light emitting diode) and other light emitting diodes can be used including the above.

In the pixel array unit 12 shown in FIG. 1, an active device such as a TFT transistor is not necessary in each pixel, which is different from the active drive system. Accordingly, the pixel unit 21 can be formed by including only the LED device formed by stacking semiconductor layers as a base and connection wiring. That is, when the pixel unit 21 is used for the display panel, the display panel can be manufactured reasonably by simple processes at extremely low costs.

It is desirable that the pixel array unit 12 and drive circuits thereof are manufactured separately and they are electrically integrated in a stage of mounting components of the image display device 1 when utilizing the advantage.

2. Configuration Example of Drivers

Next, a configuration example of drivers in drive circuits will be explained.

Figure 2:
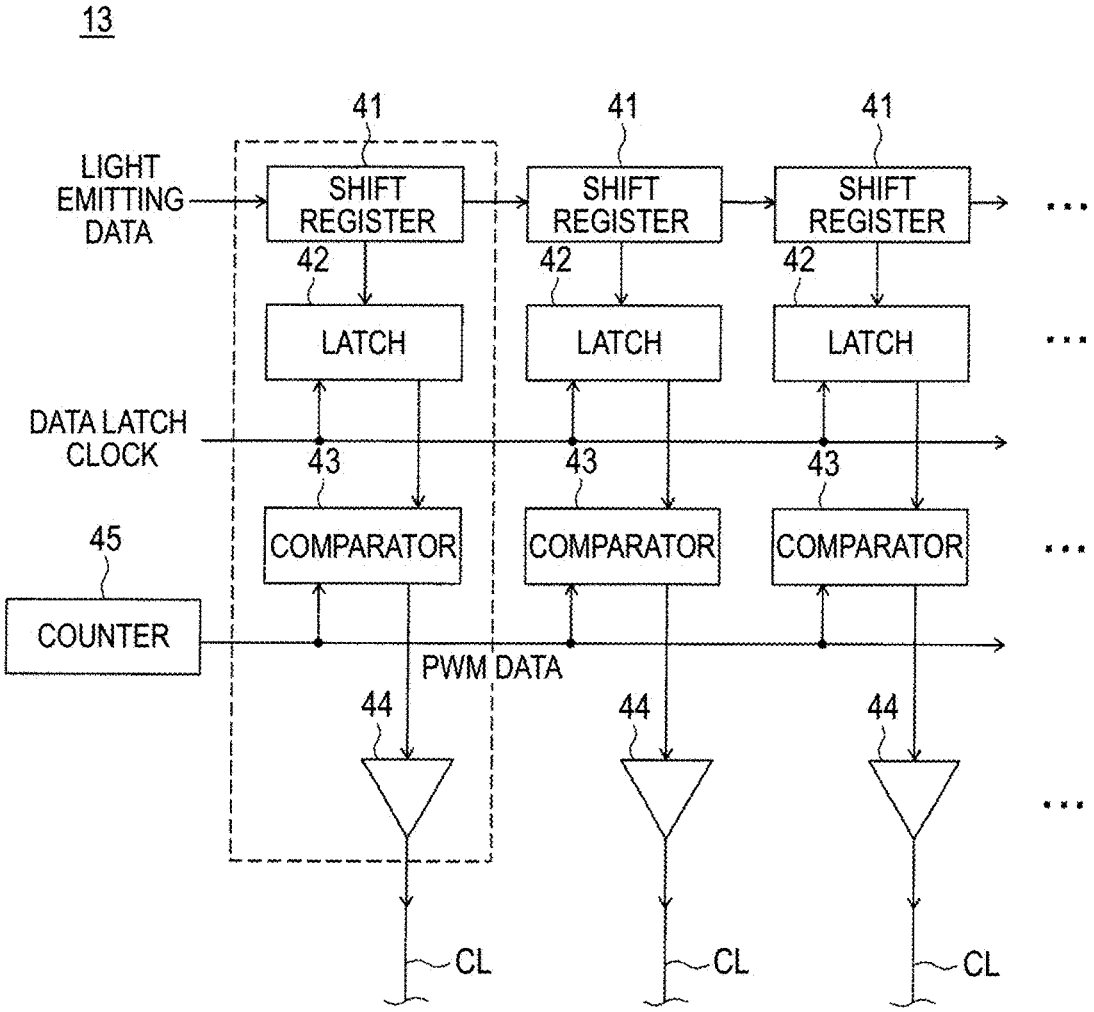
FIG. 2 is a diagram showing a basic configuration of a data driver according to the embodiment of the invention.

FIG. 2 shows a basic configuration of the data driver 13.

The data driver 13 shown in FIG. 2 includes a shift register 41, a latch 42, a comparator 43 and a driver 44 as a configuration for driving one column line CL shown in FIG. 1 (a portion surrounded by a dashed line of FIG. 2). This configuration is provided so as to correspond to the number of column lines CL to be driven. That is, the configuration surrounded by the dashed line of FIG. 2 is normally provided so as to correspond to the number which is three times the number of pixels arranged in the horizontal direction in one frame. However, in the embodiment, the number of column lines can be reduced to the number which is smaller than the number three times the number of display pixels, which will be described later in detail, therefore, the number of the basic configurations of the data driver 13 can be reduced.

The necessary number of shift registers 41 is shown as three in this case, and all registers are connected in series.

Image data signals supplied from the controller 11 are sequentially shifted by the shift registers 41. When all image data signals of a certain row are transmitted to the plural shift registers 41 of given positions, these shift registers 41 supply the signals to corresponding plural latches 42 to be stored (latched) therein.

The plural latches 42 receive supply of a data latch clock and supply the stored data signals to the corresponding given number of comparators 43 simultaneously at given timing.

The comparator 43 controls the driver 44 driving the pixel unit 21 by PWM (Pulse Width Modulation) control. That is, the comparator 43 controls a period of time during which the driver 44 is turned on in a given period (PWM period) based on the data signal supplied from the latch 42, thereby controlling a light emitting period of the pixel unit 21. The driver 44 drives the pixel unit 21 based on the control by the comparator 43. The shift register 41 and the latch 42 execute data transmission and latch of the next line during the pixel unit 21 is driven by the comparator 43 and the driver 44.

In FIG. 2, a counter 45 counting the number of clocks used for the PWM control by the comparators 43 is provided.

Only three basic configurations of the data driver are shown in FIG. 2, however, the number thereof will be considerably increased, for example, even when assuming the number to be three times the number of display pixels. The number is increased in accordance with definition of the display image. Though the number of column lines CL can be reduced in the embodiment as described later, several hundred to several thousand basic configurations of the data driver will be necessary in total.

Normally, the data driver 13 is formed by an IC driver in which several hundred to several thousand basic configurations (also referred to as channels "ch") are integrated to one IC. Also in the case, several dozen to several hundred IC drivers are necessary. In such embodiment, synchronous control of the IC drivers is indispensable. The IC drivers have preferably the same configuration, and it is necessary to avoid a configuration in which the drive ability differs according to the color, because it increases manufacturing costs. That is, it is desirable that the ability of the data driver is fixed even when corresponding colors are different.

Figure 3:
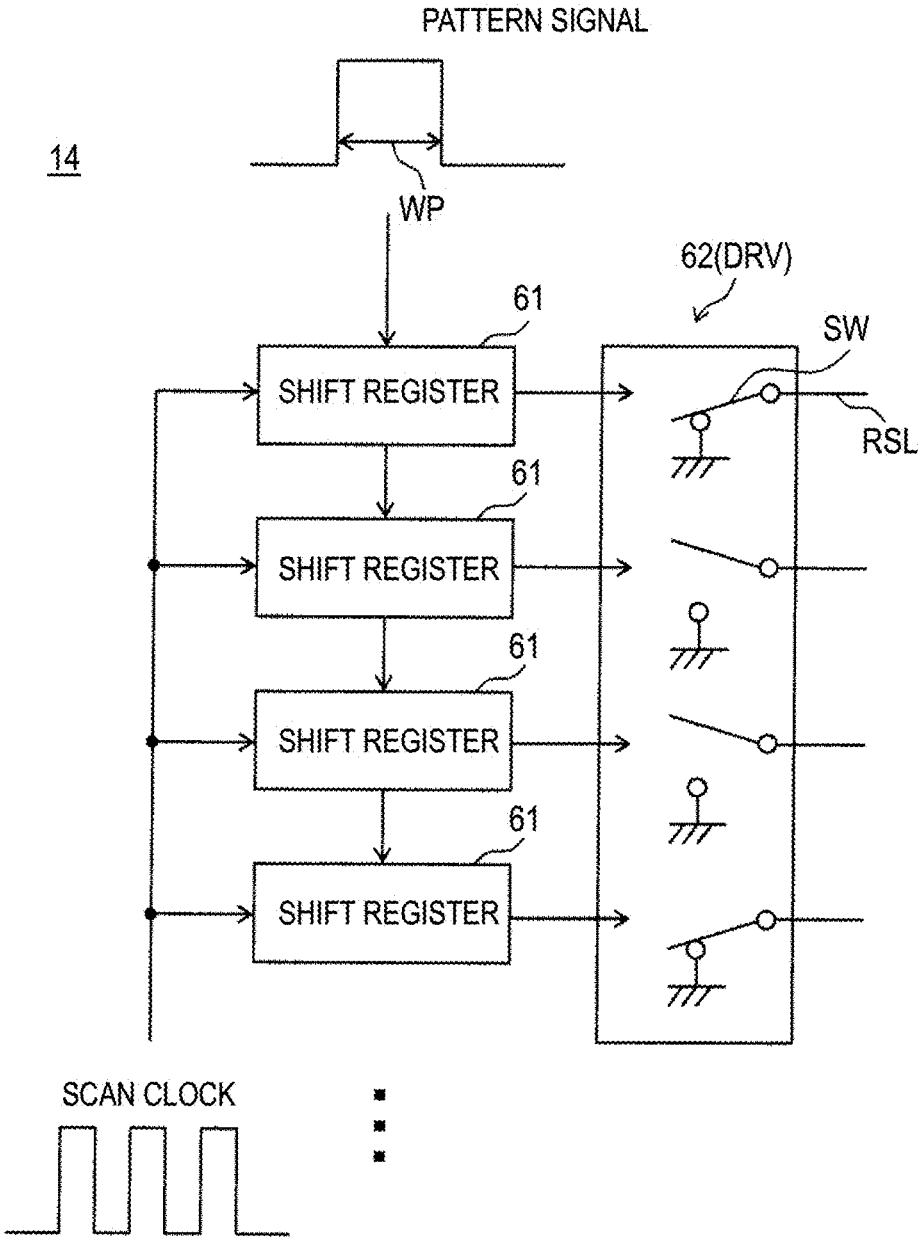
FIG. 3 is a diagram showing a basic configuration of a scan driver according to the embodiment of the invention.

FIG. 3 shows one basic configuration of the scan drivers 14G, 14B and 14R.

The basic configuration shown in FIG. 3 is the same in the scan drivers 14G, 14B and 14R, however, the number of lines driven at the same time differs in the scan drivers 14G, 14B and 14G.

The basic configuration of the scan driver includes shift registers 61 corresponding to the number of the row-scanning line RSL, which are provided so as to correspond to each color in the pixel array unit 12 (FIG. 1) and a scan driver (DRV) 62.

The shift register 61 receives pattern signals of each frame which are different according to the color from the controller 11 (FIG. 1) and forwards the pattern signals sequentially by the shift register 61. When the pattern signals are inputted to the shift registers 61 at given positions, the scan driver 62 provided corresponding to each of the given number of row-scanning lines RSL is activated.

The scan driver 62 includes switches SW for reducing the potential of the row-scanning lines RSL to the ground potential. When the scan driver 62 is activated by control of the controller 11, ON/OFF of the switches of the shift registers 61 are determined in accordance with the pattern signals stored in corresponding plural (four in this case) shift registers 61.

In the shown example, the switch SW is turned on to ground the row-scanning line RSL when the pattern signal is "H". In other patterns, the row-scanning lines RSL are controlled to be in high impedance.

The configuration is also realized by combining with ICs driving the given number of rows corresponding to each color.

When the data signal is given to the column lines CL by the data driver 13 of FIG. 2 as well as the row-scanning lines RSL are grounded by the switches SW of FIG. 3, electric current corresponding to the data signal flows through the light emitting devices connected to both lines. Accordingly, the light emitting devices emit light at luminance (light emitting luminance) corresponding to the data signal. The lighting period is determined by, for example, the pulse width of the pattern signal, or a pixel-driving pulse width when the pixel-driving pulse width of the data signal is smaller than the pulse width.

The scan driver 14 may previously transmit the same pattern signal to drivers subsequent to the activated scan driver 62 and switches the scan driver 62 to be activated to thereby perform scanning operation in the row direction. It is also preferable to drive the next set of row-scanning lines RSL by transmitting the same pattern signal to the next at the scan clock when time permits.

3. Detailed Connection Configuration Example of Light-Emitting Devices

Figure 4:
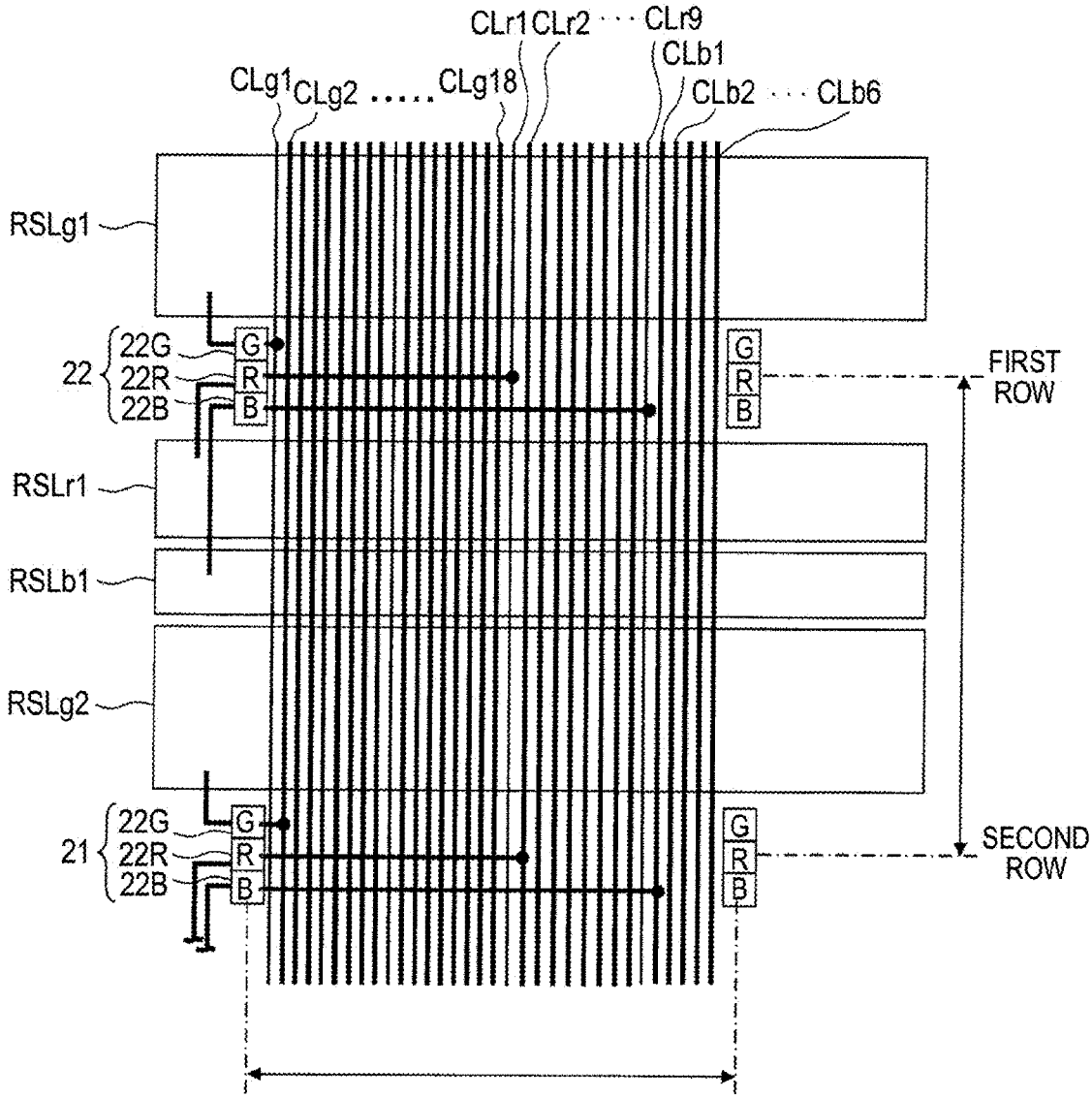
FIG. 4 is an explanatory diagram showing a detailed arrangement example of column lines and row-scanning lines in a pixel array unit.

FIG. 4 shows a detailed arrangement example of the column lines CL and the row-scanning lines RSL in the pixel array unit 12 shown in FIG. 1 inaccurately.

In FIG. 4, the pixel unit 21 includes the pixel trio of the light emitting devices 22G, 22R and 22B represented by signs "G", "R" and "B". The light emitting devices 22G, 22R and 22B have the same size, that is, for example, the same light emitting area. As a large number of column lines CL are arranged in the row-direction (horizontal direction) as shown in the drawing, the light emitting devices 22G, 22R and 22B are arranged in a column so as not to interfere with the arrangement of the column lines CL. Four pixel trios are shown here, however, several hundred to a little over one thousand pixel units 21 are actually arranged in the row direction at equal intervals.

Concerning the column lines CL, G column lines CLg a corresponding color of which is green (G), R column lines CLr a corresponding color of which is Red (R) and a B column lines CLb a corresponding color of which is blue (B) are arranged in a cyclic manner with given proportion respectively. The proportion of the wiring lines is R:G:B=9:18:6 (=3:6:2).

Concerning left two pixel units 21 in four pixel units 21 arranged in FIG. 4, connections between the column lines and the light emitting devices are shown. In the upper left pixel unit 21, the light emitting device 22G is connected to the first G column line CLg1 by an inner line. Similarly, the light emitting device 22G is connected to the first R column line CLr1 by an inner line. The light emitting device 22B is connected to the first B column line CLb1 by an inner line.

In the row arrangement of the pixel trios (pixel units 21) of the first row, other pixel units 21 have similar connection. Therefore, the numbers (proportion) of light emitting devices which can emit light of respective colors are fixed in the same row.

In the second row, column lines CL as connection destinations are the second lines (CLg2, CLr2 and CLb2), and the connection is performed in the same manner in the same row, therefore, the proportion of numbers of devices which can emit light of respective colors is fixed.

In the case that the number of column lines C1 differs in green (G), red (R) and blue (B), the number of devices which can emit light differs in accordance with the data signal independent in the column direction. That is, the number of column lines of green (G) is largest, which is 18, therefore, the number of devices which can emit light in the same column is largest in the same proportion as the proportion. On the other hand, the number of column lines of blue (B) is smallest, which is 6, therefore, the number of devices which can emit light in the same column is the smallest in the same proportion as the proportion. Concerning red (R), the number of devices which can emit light is determined between the number of both.

In FIG. 4, though the row-scanning lines RSL are shown by bold wiring lines for convenient, it has no relation to the actual size of wiring lines. The size of wiring lines in FIG. 4 represents closeness of the number of wiring lines. That is, the drawing shows that wiring space is enough in the row-scanning lines RSL as compared with the column lines CL.

The light emitting device 22G is connected to an RSLg1 for G, the light emitting device 22R is connected to an RSLr1 for R and the light emitting device 22B is connected to an RSLb1 for B. These three row-scanning line RSLs are used in common in the same row, however, they are not used in common in different rows (other wiring lines are used).

The driver configuration of FIG. 3 performs control so that the given pattern signal having a pulse width Wp is activated to ground the row-scanning lines RSL of respective colors. The control is performed at the three scan drivers 14G, 14B and 14R at the same time in each color shown in FIG. 1. At this time, for example, when necessary lighting periods are RGB=4:8:3 as described later, the pulse width Wp has also the proportion of 4:8:3 in the scan drivers 14G, 14B and 14R. The lighting periods are defined by, for example, multiples of the clock, and the pulse width of red (R) is four-clocks, the pulse width of green (G) is eight-clocks and the pulse width of blue (B) is two-clocks.

4. Proportion of Arranging Column Lines in Respective Colors

The proportion of RGB=4:8:3 has the following meaning. For example, when two lines are lit at the same time in an 18-inch panel, suitable electric current allowed to flow through respective LED pixels of RGB is approximately RGB=4:8:2. This is due to light emitting wavelength and efficiency of InGaN devices forming the LED (light emitting devices 22) of "G" and "B". Efficiency improvement of green (G) with respect to blue (B) in the similar chip size is difficult. Even when the luminance insufficiency is intended to be increased by applying current, lowering of efficiency and lowering of reliability are caused due to saturation characteristics between current and luminance, which is not desirable. It is preferable that the proportion of RGB=4:8:2 is applied as proportion of the wiring number of the column lines CL, and it is more preferable that the proportion is fine-adjusted so as to fit into visible sensitivity.

The electric current applied to blue (B) with respect to green (G) is less than half, however, it is possible to allow the same level of electric current as green (G) to flow through blue (B). Red (R) is a GaAs device and does not have direct relation, however, it is possible to increase electric current due to the passive driving and pulse lighting.

When RGB are all driven by the same electric current by using the above characteristics of devices, the necessary lighting periods of time are RGB=4:8:3 from respective luminance characteristics between current and luminance. The necessary lighting periods in this case mean relative periods of time to be adapted so as not to reduce visible-sensitivity characteristics.

That is, when the screen size is increased and display luminance is reduced (the screen becomes dark), the display luminance is changed so as to increase the RGB proportion in the same proportion in related art (Patent Document 2 and later described comparative examples), however, balance between RGB proportion in the visible sensitivity and RGB proportion of the display image is lost, as a result, it is difficult to keep color quality. In the light of the above, the proportion of RGB=4:8:3 is determined.

As described above, the number of light emitting devices which can emit light with peculiar luminance in accordance with the data signal in the same one column will be the same proportion of RGB=4:8:3 so as to correspond to the above proportion of RGB=4:8:3. On the other hand, the number of devices of respective colors which emit light in the same one row is fixed. For example, assume that the row-scanning driving by 18 rows which is equal to the maximum number of column wiring lines 18 in respective colors in the case of FIG. 4 is performed. At that time, the number of light emitting devices which can emit light with peculiar luminance in accordance with the data signal will be RGB=4:8:3. The row-scanning is controlled by repeating the scanning to display one-frame screen, therefore, the proportion of colors within one screen is kept to RGB=4:8:3. Additionally, the luminance of the whole screen can be changed by increasing and decreasing the number of column lines while keeping the proportion.

Advantages of changing the proportion of the column lines CL in respective colors are clearly shown by contrast with comparative examples as follows.

5. Comparative Examples

Comparative examples to which the invention is not applied in the method of allowing plural lines to simultaneously emit light in the line-sequential method will be explained. The comparative examples basically correspond to the driving method of Patent Document 2 described above.

First Comparative Example

Figure 5:
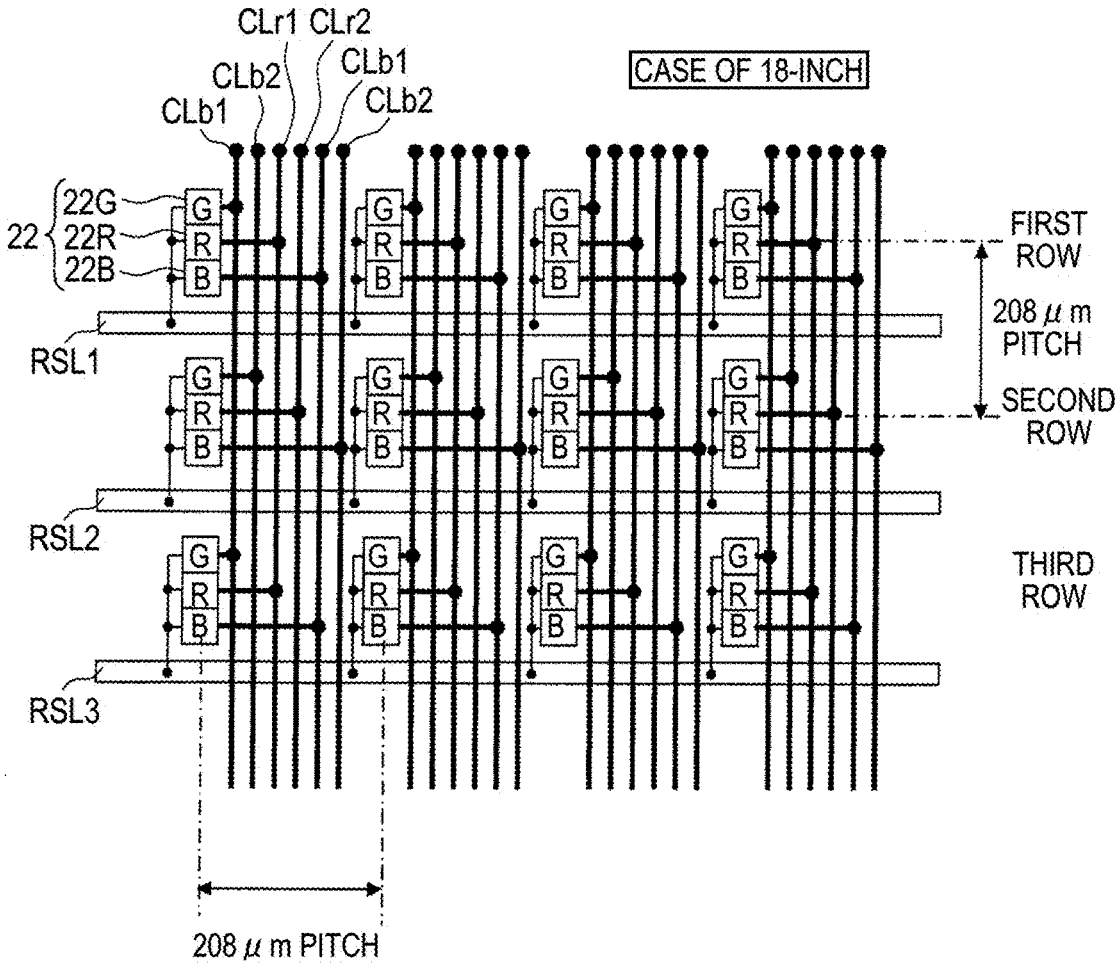
FIG. 5 is a configuration diagram of a basic pixel array of a first comparative example.

FIG. 5 shows a basic configuration diagram of a pixel array of a first comparative example.

Figure 6:
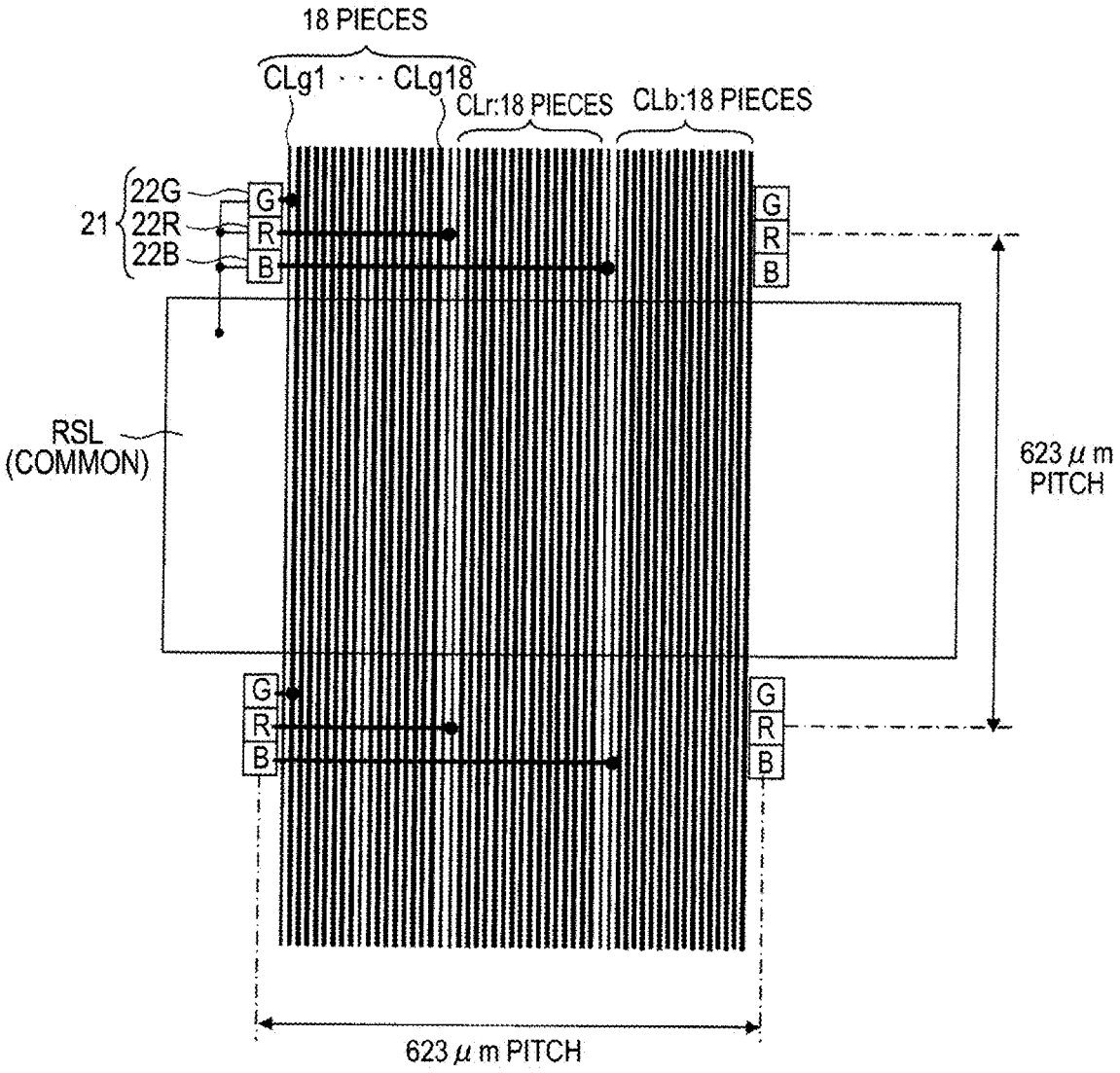
FIG. 6 is a configuration diagram of a basic pixel array of a second comparative example.

For example, a passive-driving image display device in which 1920×1080 (two-million and seventy thousand) kits of LEDs of RGB are arranged in an 18-inch FHD panel is used as an example. FIG. 6 shows a portion in which 3×4 pixels each including 3-kits of sub-pixels (pixel trios) corresponding to RGB are arranged.

The size of one LED chip emitting light which emits light of respective colors of RGB is, for example, approximately 50 (μm□). In the first comparative example, a case in which two lines are lighted at the same time to obtain necessary luminance, though depending on the size of the LED chip or drive current.

When plural lines of LEDs are lit at the same time by the passive driving as described above, independent column wiring lines with respect to respective pixel trios of RGB are necessary for driving plural lines. That is, column wiring lines of the number (3×2=6) obtained by multiplying RGB (three) by the number of lines lit at the same time (for example, two) are necessary. In this case, in pixels of the 18-inch FE-ID, the distance between pixel pitches is approximately 208 μm and when LEDs of RGB having the size of 50 (μm□) are arranged closely in the vertical direction so that the pixel size becomes 70 μm in width and 150 μm in height, the space of the horizontal direction in which lines can be wired in the same plane will be 138 μm or less. When six column lines are wired in the space, the number of lines and space (L/S) is 11 (6 lines and 5 spaces). When 138 is divided by 11, (L/S)=12.5 μm, therefore, wiring should be performed within this size.

Second Comparative Example

FIG. 6 shows a basic configuration diagram of a pixel array of a second comparative example.

In the second comparative example, a large-sized panel with the same LED pixel size is fabricated. For example, when a 54-inch panel which is three times the size of 18-inch is fabricated, the column wiring lines which are nine times (3×2×9=54) the number of the column wiring lines of 18-inch are necessary with two simultaneous lighting lines because the area will be nine times for obtaining luminance with the same driving current of LEDs though the screen size is three times.

The pixel pitch in the 54-inch panel is 623 μm, which is three times the size of the 18-inch panel, therefore, the space in which lines can be wired in the same plane is expanded a bit in the proportion of the pixel size when the pixel size is the same, however, the space is not expanded in the proportion of the area.

Even when the size of the pixel trio (pixel unit 21) actually remains at 70 μm in width and 150 μm in height, the wiring space in the horizontal direction is 553 μm or less, and it is necessary to perform wiring within 5.1 μm or less in the line and space (L/S) for wiring 54 column lines within the space.

In order to form the wiring pattern of (L/S)=5.1 μm or less over an effective screen width of the 54-inch panel, namely, 1195 mm, a manufacturing apparatus is limited and the apparatus itself will be expensive, which are unfavorable also in a point of manufacturing yield.

In order to take 54 lines per one pixel in the screen width of 1195 mm, 54×1920=103680 lead wires are necessary and the pitch will be 11.5 μm in the case of using connection pads arranged in a line. Accordingly, a structure of taking lines by an ACF (anisotropic conductive film) with arrangement of connection pads in four lines or more is actually necessary. In this case, the pad arrangement at the pitch of 46 μm or more is necessary, and it is necessary to take the width between columns, therefore, the width outside of the effective screen, namely, a so-called "frame" will be considerably wide.

In the first and the second comparative examples, display luminance is improved in a state in which the balance of visible sensitivity is lost.

6. Advantages of the Embodiment with Respect to the Comparative Examples

In the embodiment, for example, when luminance of the display screen is intended to be twice as high, the number of simultaneous lighting lines is still 2×9=18 in green (G), the number of lines is 2×9× (4/8)=9 in red (R) and the number of lines is 2×9× (3/8)=6 in blue (B) for obtaining necessary luminance in the panel based on the above-described proportion of RGB=4:8:3, therefore, 18+9+6=33 pieces of column lines are necessary, which can be largely reduced from 54 pieces (refer to the above comparative examples).

In this case, in order to put 33 lines in the wiring space of 553 μm in the horizontal direction, (L/S) should be 8.5 μm, and some methods of forming wiring process can be selected. Additionally, 33×1920=63360 of lead wires are necessary, the pitch will be 18.9 μm in the case of using connection pads arranged in a line and the pitch pad will be 39 μm in two-line arrangement, which is a level in which mass production is possible.

In order to change the number of simultaneous driving lines in RGB, it is necessary that the row-scanning line RSL which is commonly used in RGB in the case of the same number of driving lines is separated to RGB respectively.

In the case of the same number of driving lines, 1080 pieces of row-scanning lines RSL were necessary which is the same number as the horizontal lines, however, when RGB is separated, row-scanning lines RSL which are three times the number thereof are necessary.

However, the number of increased row-scanning lines RSL is negligible as compared with the number of reducing the column lines CL, and the wiring pitch and the pad pitch are increased within sufficiently responsible range.

For example, the pad pitch determined in the case that the row-scanning line RSL is common between colors in the 54-inch panel is 623 μm, which is 208 μm and no problem even when increased to three times.

When the number of simultaneous driving lines is optimized so as to correspond to respective characteristics of RGB devices as described above, not only wiring rules are simplified but also the number of column drivers (drivers 44 of FIG. 2) can be reduced.

Concerning the drivers 44, the necessary number of drivers is reduced from 108 to 66 in the embodiment when the columns are simultaneously driven at 960 ch per one driver. On the other hand, the row driver (scan driver 62 of FIG. 3) deals with high electric current, therefore, row-scanning lines can be driven at 180 ch per one driver. In this case, the necessary number of drivers is increased from 6 to 18. However, the number of drivers is reduced from 114 (=108+6) to 84 (=66+18) as a whole, which can also reduce costs.

The proportion of RGB=4:8:2 depends on materials and so on of LEDs, which may be variously changed. The proportion may be the RGB proportion of visible sensitivity and some variation may occur according to how to define the proportion of the color components.

In the case that a certain color can afford input power to be applied according to materials and so on of LEDs and there is allowance as long as balance in visible sensitivity is not lost on a large scale, the proportion of R or B having capacity of allowing electric power to flow through drivers can be increased as compared with G. In this case, overhead (energy generated wastefully because the upper limit of actual use is lower than ability) of drivers can be reduced, which leads to cost reduction.

The row-scanning lines RSL are separated according to the color, however, the row-scanning line responsive to red (R) and blue (B) through which flowing current is low can be used in common.

According to the above configuration, it is possible to provide a method of manufacturing a panel with the small number of wiring lines while keeping sufficient luminance by a simple passive diving circuit by using light emitting devices of RGB.

Particularly in order to reduce the number of wiring lines, driving current for red (R) and blue (B) is increased based on the number of column wiring lines of green (G) having low efficiency, while the number of column wiring lines of red (R) and blue (B) is reduced. For that purpose, the number of simultaneous lighting lines of RGB is changed between green (G) and red (R) or between green (G) and blue (B), or by using different row-scanning lines RSL in RGB respectively.

Accordingly, wiring rules are simplified and processes and equipment for manufacturing panels are simplified as well as the number of column drivers can be reduced, and further, rules of connection pads with respect to the outside and the number of connection can be also reduced, which can provide the image display device manufactured at relatively low costs.

The present application contains subject matter related to that disclosed in Japanese Priority Patent Application JP 2009-230852 filed in the Japan Patent Office on Oct. 2, 2009, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A self-light emitting device panel comprising:

a pixel array comprising pixel trios each including a set of three light emitting devices which emit light of three primary colors respectively, wherein the pixel trios are arranged in a matrix in a row direction and a column direction;

a plurality of column lines extending in the column direction of the pixel array, and arranged in a cyclic manner in different proportions according to corresponding colors in the row direction, wherein the plurality of column lines are connected to first ends of the light emitting devices emitting light of the corresponding colors in a column of the pixel trios arranged in the same column; and a plurality of row-scanning lines extending in the row direction of the pixel array, and arranged so as to be separated according to at least two of the primary colors, wherein the plurality of row-scanning lines are connected to second ends of the light emitting devices emitting light of the corresponding colors, wherein a number of the plurality of column lines in respective colors of the light emitting devices to which respective column lines are connected in the column of the pixel trios is determined such that light emitting luminance of the three primary colors corresponds to proportions of color components in visible sensitivity in plural rows of the pixel trios.

2. The self-light emitting device panel according to claim 1, wherein a number of the plurality of column lines in respective colors of the light emitting devices to which respective column lines are connected in the column of the pixel trios are determined so that light emitting luminance of the three primary colors corresponds to proportions of color components in visible sensitivity in plural rows of the pixel trios simultaneously emitting light when the same electric current flows through the plurality of column lines corresponding to different colors, in accordance with difference of characteristics between current and luminance possessed by the light emitting devices of respective colors.

3. The self-light emitting device panel according to claim 1, wherein a light emitting area of the light emitting devices in respective colors is the same in each of the pixel trios.

4. The self-light emitting device panel according to claim 3, wherein a light emitting device from the set of three light emitting devices emitting red (R) in the three primary colors is a GsAs compound semiconductor LED, and light emitting devices from the set of three light emitting devices emitting green (G) and blue (B) are indium gallium nitride (InGaN) compound semiconductor LEDs.

5. The self-light emitting device panel according to claim 3, wherein a number of the plurality of column lines in respective colors of the light emitting devices to which respective column lines are connected in the column of the pixel trios are determined so that light emitting luminance of the three primary colors corresponds to proportions of color components in visible sensitivity in plural rows of the pixel trios simultaneously emitting light when the same electric current flows through the plurality of column lines corresponding to different colors, in accordance with difference of characteristics between current and luminance possessed by the light emitting devices of respective colors.

6. An image display device comprising:

a pixel array comprising pixel trios each including a set of three light emitting devices which emit light of three primary colors respectively, wherein the pixel trios are arranged in a matrix in a row direction and a column direction;

a plurality of column lines extending in the column direction of the pixel array, and arranged in a cyclic manner in different proportions according to corresponding colors in the row direction, wherein the plurality of column lines are connected to first ends of the light emitting devices emitting light of corresponding colors in a column of the pixel trios arranged in the same column;

a plurality of row-scanning lines extending in the row direction of the pixel array, and arranged so as to be separated according to at least two of the primary colors, wherein the plurality of row-scanning lines are connected to second ends of the light emitting devices emitting light of corresponding colors;

a data driver to drive the plurality of column lines by electric current in accordance with input data; and scan drivers to simultaneously drive different numbers of the plurality of row-scanning lines according to a color for forming paths of current flowing through the light emitting devices in plural rows of the pixel trios at the same time by the data driver, and sequentially repeating the operation of simultaneous driving in the row direction, wherein the scan drivers allow the light emitting devices to emit light simultaneously at respective rows of the pixel array in the same proportion in respective colors and sequentially scan simultaneous lighting of plural rows in the column direction, which allows light emitting devices of respective colors to emit light in plural rows of the pixel trios at the same time in the same proportions as proportions of the plurality of column lines arranged in the row direction in one row of the pixel array, and wherein a number of the plurality of column lines in respective colors of the light emitting devices to which respective column lines are connected in the column of the pixel trios are determined so that light emitting luminance of the three primary colors corresponds to proportions of color components in visible sensitivity in plural rows of the pixel trios simultaneously emitting light when the same electric current flows through the plurality of column lines corresponding to different colors, in accordance with difference of characteristics between current and luminance possessed by the light emitting devices of respective colors.

7. The image display device according to claim 6, wherein the data driver has fixed ability of driving respective columns by electric current.

8. The image display device according to claim 6, wherein the number of the plurality of column lines in respective colors of the light emitting devices to which respective column lines are connected in the column of the pixel trios are determined so that light emitting luminance of the three primary colors corresponds to proportions of color components in visible sensitivity in plural rows of the pixel trios simultaneously emitting light when the same electric current flows through the plurality of column lines corresponding to different colors, in accordance with difference of characteristics between current and luminance possessed by the light emitting devices of respective colors.

9. A self-light emitting device panel comprising:

a pixel array comprising pixel trios each including a set of three light emitting devices which emit light of three primary colors respectively, wherein the pixel trios are arranged in a matrix in a row direction and a column direction;

a plurality of column lines extending in the column direction of the pixel array, and arranged in a cyclic manner in different proportions according to corresponding colors in the row direction, wherein the plurality of column lines are connected to first ends of the light emitting devices emitting light of corresponding colors in a column of the pixel trios arranged in the same column; and a plurality of row-scanning lines extending in the row direction of the pixel array, and arranged so as to be separated according to at least two of the primary colors, wherein the plurality of row-scanning lines are connected to second ends of the light emitting devices emitting light of the corresponding colors, wherein a light emitting area of the light emitting devices in respective colors is the same in each of the pixel trios, and wherein a light emitting device (LED) from the set of three light emitting devices emitting red (R) in the three primary colors is a GsAs compound semiconductor LED, and light emitting devices from the set of three light emitting devices emitting green (G) and blue (B) are indium gallium nitride (InGaN) compound semiconductor LEDs.

* * * * *